United States Patent [19]

Gibb

[11] Patent Number: 4,622,251

[45] Date of Patent: Nov. 11, 1986

[54] NON-COMBUSTIBLE FILLER ROD FOR PROVIDING FIRE TIGHT JOINT PACKING

[75] Inventor: John F. Gibb, Littleton, Colo.

[73] Assignee: Backer Rod Manufacturing & Supply Co., Denver, Colo.

[21] Appl. No.: 692,502

[22] Filed: Jan. 18, 1985

[51] Int. Cl.[4] ..... F24F 7/00

[52] U.S. Cl. ..... 428/36; 52/396; 52/404; 52/406; 252/62; 277/191; 428/359; 428/920

[58] Field of Search ..... 428/920, 921, 359, 365, 428/443, 36; 52/406, 404, 393, 396, 403; 277/190, 191; 252/62

[56] References Cited

U.S. PATENT DOCUMENTS 3,244,632 4/1966 Schulz et al. ..... 252/62
4,210,070 7/1980 Tatum et al. ..... 428/920

OTHER PUBLICATIONS

"Fire Tests of Joints Between Precast Concrete Wall Panels: Effect of Various Joint Treatments", by Gustaferro et al., Portland Cement Association, 10/1975.

*Primary Examiner*—John E. Kittle
*Attorney, Agent, or Firm*—Klass & Law

[57] ABSTRACT

A non-combustible construction product for sealing a joint formed between adjoined building panels for blocking the passage of flame therethrough including non-combustible, flexibly compressible packing material encased within a porous, non-combustible, flexible, tubular sheath. A method of producing and installing such a construction product is described. Various packing materials including ceramic fibers and a combination of ceramic fibers and heat expandable mineral particles are described.

9 Claims, 11 Drawing Figures

NON-COMBUSTIBLE FILLER ROD FOR PROVIDING FIRE TIGHT JOINT PACKING

BACKGROUND OF THE INVENTION

The present invention relates generally to fire resistant construction materials and more particularly to a non-combustible joint packing product for preventing the spread of fire through a joint formed by adjacent building panels, and to the production and installation of such a joint packing product.

The use of prestressed, precast concrete panels, including curtain wall, in the construction of buildings is well known in the construction arts. Such panels may be used to clad the exterior walls of buildings and may also serve as portions of interior walls. In forming walls from such panels, the panels are spaced apart to allow for expansion and contraction. The width of the gap or joint between these wall panels is generally on the order of one-quarter inch to one inch.

It has been found that when one surface of a wall formed from such panels is exposed to fire, the capacity of the wall to withstand heat and to prevent the spread of fire to the area on the opposite side of the wall is largely dependant upon the type of material used to fill or seal off the joints between panels.

A problem encountered in joint preparation for resisting the penetration of heat and/or flames has been that during fire conditions an air pressure differential develops between the side of the wall exposed to the fire and the opposite side of the wall. The heat of the fire tends to shrink or burn away any sealant material provided at the surface of a joint and the pressure differential between the two sides of the wall tends to cause any other material which is positioned within the joint to be blown out of position or to be distorted, allowing the rapid passage of air and thus heat and/or flame from the fire side of the wall to the opposite side of the wall. Once such a flame passage through the joint is provided, fire and smoke spread quickly through the wall to the adjoining area, thus defeating the otherwise excellent fire resistant properties of prestressed, precast concrete and curtain wall panels.

In order to prevent the spread of fire through joints, various joint treatments have been utilized which provide a layer of blanket like fire resistant material which is supported in position by a polyethylene, closed-cell backup strip positioned adjacent to the fire proof blanket material or alternately positioned near the opposite wall surface of the joint in an attempt to stabilize the fire resistant blanket material within the joint. A problem with such a solution has been that the handling and installation of blanket material and a foam rod is relatively slow and labor intensive and thus considerably increases the cost of joint preparation.

Various materials and procedures for forming fire resistant joints are discussed in a publication of the Portland Cement Association entitled "Fire Tests of Joints Between Pre-Cast Concrete Wall Panels: Effects of Various Joint Treatments" by A. H. Gustarerro and M. S. Abrams, *PCI Journal*, September/October 1975, pages 44–64. This report indicates that it is known to treat a joint for fire prevention by placing a neoprene tube filled with ceramic fibers in a portion of the joint slightly recessed from one wall surface and to thereafter seal off the recess space between the neoprene tube and wall face with a joint sealing material such as polyoxide urethane sealant. A problem with the use of a neoprene tube filled with ceramic fibers is that neoprene has limited heat resistance and produces substantial smoke emission when it oxidizes. Another problem is that the placement of ceramic fiber into a tube is extremely slow and expensive and is therefore impractical in lengths of more than a few inches.

It is an object of the present invention to provide a method for preparing wall joints which results in a joint filling which remains in position and which prevents passage of heat and flame through a joint even after continued exposure to heat and/or flame at one side of a wall formed by concrete or other similar panels.

It is also an object of the invention to provide such a joint treatment wherein the joint treatment requires a relatively small amount of labor.

It is another object of the invention to provide such a joint treatment using relatively low cost, low density material.

It is a further object of the invention to provide a method for manufacturing such joint preparation material in a relatively low cost, relatively high speed operation.

SUMMARY OF THE INVENTION

The present invention comprises a filler rod which may be positioned in a joint between building panels to form a fire tight seal which will prevent the propagation of flame through the joint and which will remain effective and which will be retained in position even when exposed to extreme heat and/or pressure.

The invention also comprises a method and apparatus for producing such a filler rod in a relatively high speed and relatively inexpensive manner.

DETAILED DESCRIPTION OF THE INVENTION

Figures 1, 11:
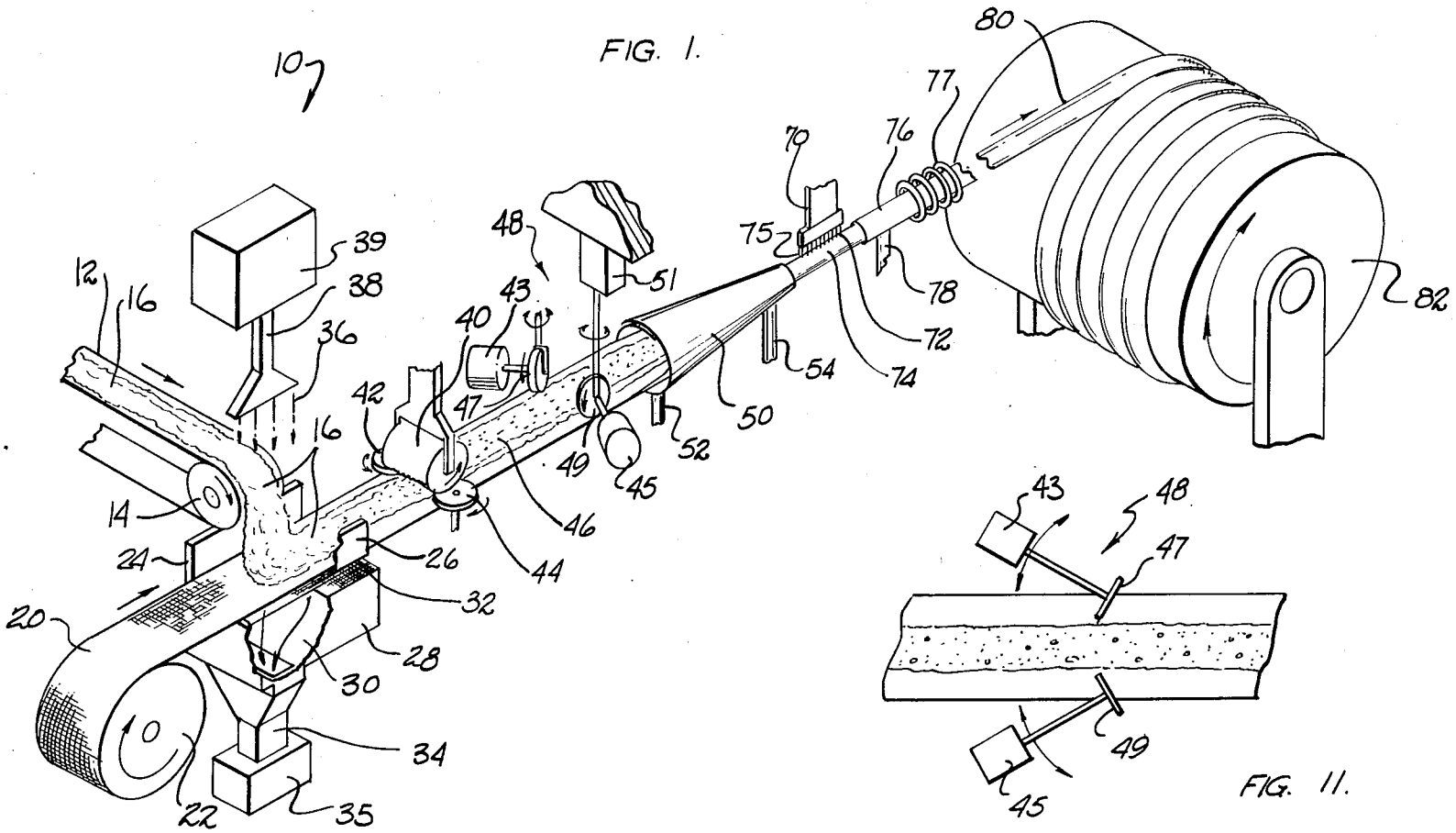
FIG. 1 is a schematic perspective view of an apparatus for forming a non-combustible joint filler rod.
FIG. 11 is a schematic top view of a lateral tensioning means portion of the apparatus of FIG. 1.
Figure 6:
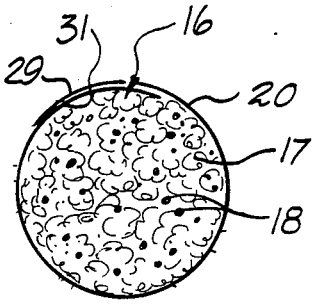
FIG. 6 is a cross-sectional view of another embodiment of a joint filler rod of the present invention.

A non-combustible joint filler rod forming apparatus 10 of the present invention is illustrated in schematic form in FIG. 1. An endless conveyor belt 12 conventionally driven by conveyor rollers 14 (only one shown)

carries a uniform, continuous supply of backer rod filling material 16 to a continuously moving web of porous sheathing material 20. The backer rod filling material 16 of the present invention, in one embodiment, comprises a non-combustible, porous fiber material 17 such as, for example, ceramic fiber or mineral wool. The fiber material comprises a number of relatively short length, e.g., 1/64 inch to ¼ inch maximum dimension randomly oriented, fiber particles. The fiber material is produced by conventional fiber forming techniques and has the property of being flexible, resiliently compressible and relatively light weight due to its porous composition. In another embodiment of the invention, as illustrated in FIG. 6, the fiber material 17 may be mixed with a number of relatively small particles, e.g. 1/64 inch to ⅛ inch and maximum dimension, of minerals 18 such as unexpanded vermiculite and/or perolite which have the property of expanding in volume when exposed to intense heat. The diametric expansion ratio of vermiculite and perolite when exposed to temperatures, of e.g., 400° F., or above, is on the order of ten to one.

Figure 7:
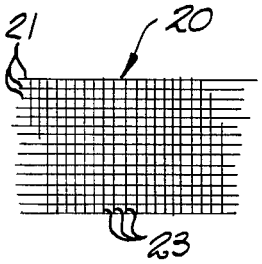
FIG. 7 is a plan view of a portion of a sheathing web used in forming a joint filler rod of the present invention.

The porous sheathing material 20 may be constructed from a number of non-combustible, open-weave materials such as fiber glass or the like. As illustrated by FIG. 7, in one embodiment the sheathing material has an open rectangular weave formed by a plurality of longitudinally extending fiber glass strands 21 weavingly intermeshed with a plurality of transversely extending strands 23. Sheathing material of this composition may be formed by conventional fiber glass weaving techniques which are well known in the art. The fiber glass strands may have a thickness of between 0.004 inches and 0.01 inches and the amount of porosity, i.e., open space in the weave, may be between 20% and 85%.

Referring again to FIG. 1, it may be seen that a continuous web of sheathing material 20 is provided from a conventional unwind roll 22 which may be a driven roll or alternatively an idler roll adapted to unwind purely through the drawing tension placed on the web by an upstream drawing device such as driven windup roll 82. A portion of the web of sheathing material 20 passing directly below a discharge end of conveyor belt 12 is received between two longitudinally extending guide panels 24, 26. The guide panels serve to prevent waste by channeling the filler material 16 onto the moving web of sheathing material 20. The guide panels 24, 26 are supported at opposite ends thereof on an exhaust air housing 28 of generally parallelepiped configuration, i.e., rectangular box-like configuration, by conventional means such as welding or the like. Exhaust air housing 28 defines an exhaust air chamber 30 therewithin. An open upper portion of the exhaust air housing 28 is covered by an open web support means such as support screen 32 which is fixedly attached at its periphery to the upper edge of the housing 28 by conventional means. The lower portion of exhaust housing 28 communicates with an exhaust duct 34 which may in turn be connected to an air forcing means such as a lower induction fan 35 or the like for drawing air through the exhaust air chamber 30. A downwardly directed vertical air stream 36 which may have a linear volocity of 2 feet per second to 5 feet per second is generated immediately above the portion of web 20 supported on the screen and acts to guidingly deflect filler material 16 falling from the conveyor belt 12 onto the moving web of sheathing material 20. The vertical air stream may be provided by an inflow air duct 38 which is in fluid communication with an air forcing means such as an upper induction fan 39 or the like. Thus the air forcing means 35, 39 and associated conduit provide a filler material guiding air flow means which directs the filler material directly onto the moving sheathing web 20.

A compacting means may be provided immediately downstream from the point where the filler material 16 is deposited on the moving web 20. The compacting means may comprise a horizontal roller 40 and a pair of opposite vertically oriented rollers 42, 44 which orient the filler material 16 at the center of the sheathing web 20 and which also urge the filler material into a slightly compacted longitudinally extending strip 46. Upon leaving the compacting means, the moving web 20 passes through a web lateral tensioning means 48 which provides tension to the moving web 20 in a lateral direction to provide a uniform tension for forming longitudinally and transversely uniform interstices between the web strands 21, 23 and to prevent wrinkling and associated problems during downstream folding of the web. As illustrated by FIGS. 1 and 11, the lateral tensioning means 48 may comprise a pair of roller 47, 49 driven by conventional drive means such as electric motors 43, 45. The driven rollers have horizontal axes of rotation and are mounted in skewed relationship with respect to the direction of web travel, e.g. 30° to 60° from a parallel orientation. The driven rollers 47, 49 may be constructed of a smooth material having a relatively high coefficient of friction such as rubber or the like. The rollers 47, 49 are urged downwardly against the web, as by a spring assembly 51 (only one shown). The downward force is of a magnitude sufficient to produce frictional contact with the web, but is not so great as to cause substantial vertical distortion of the web or to disturb the placement of the filling material 16. The driven rollers 47, 49 are rotated in a direction such that they have a forwardly and outwardly directed tangential speed at the surface thereof at the position of web contact whereby the web is urged outwardly and brought into a state of tension. The web is thus maintained, generally, in a common horizontal plane. The amount of tension produced in the web may be controlled by increasing or decreasing the rotational velocity of the rollers 47, 49, the two rollers being maintained at identical speed. Additional fine speed adjustment may be provided by controlling the relative angle of the rollers with respect to the direction of web travel as by an adjustable swivel mounting arrangement enabling pivotal movement of the rollers about vertical axes.

Figure 2:
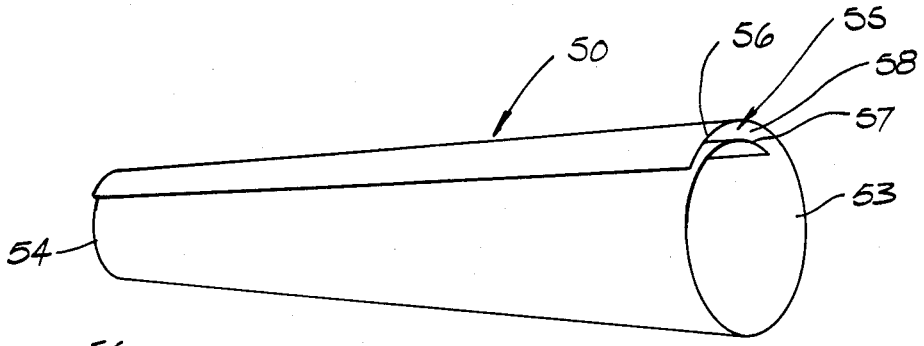
FIG. 2 is a perspective view of a folding cone used in the apparatus of FIG. 1.
Figure 3:
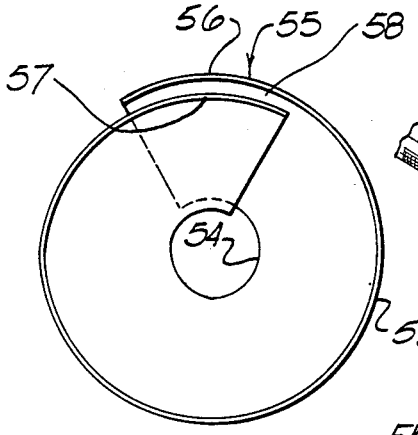
FIG. 3 is an end elevation view of the folding cone of FIG. 2.
Figure 4:
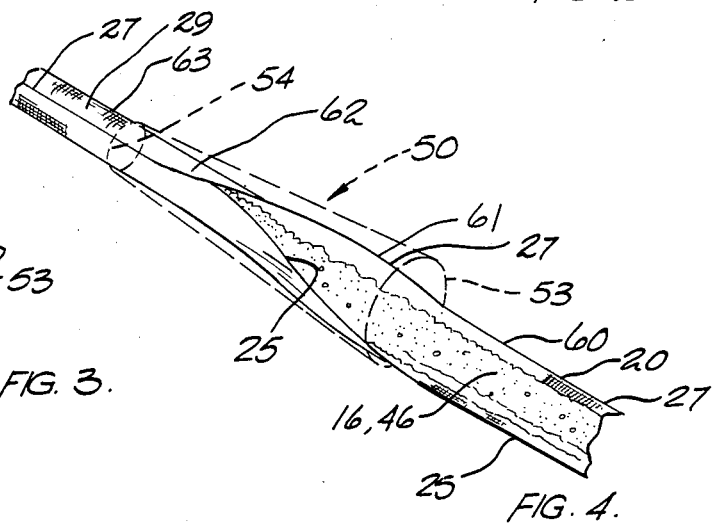
FIG. 4 is a transparent perspective view illustrating the operation of the folding cone of FIGS. 2 and 3.
Figure 5:
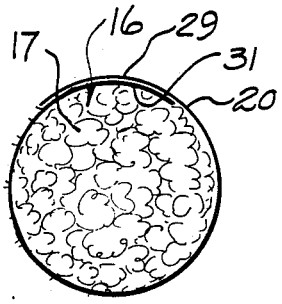
FIG. 5 is a cross-sectional view of one embodiment of a joint filler rod of the present invention.

Referring again to FIG. 1, it may be seen that after passing through the lateral tensioning means 48 the web of filler material 20 enters a folding means such as folding cone 50 which may be supported on a suitable base (not shown) by vertical support members 52, 54 which are fixedly attached to a lower surface of the folding cone as by welding or other conventional attachment means. As illustrated by FIGS. 2–4, folding cone 50 comprises an upstream end 53 of relatively large, generally circular cross-section and a downstream end 54 of relatively smaller, generally circular cross-section. The folding cone is not a "true cone" in that it does not have a continuous interior surface. Rather, the folding cone is formed by a sheet of material formed into a generally conical configuration, but having an unconnected overlapping section 55 with an overlapping upper portion 56 and a lower portion 57 which define an open seam 58 therebetween. In a typical embodiment, the diameter of the cone upstream end 53, may be, for example, three inches, the diameter of the downstream end 54 may be, for example ¾ inch. The length of the cone may be, for example, twelve inches and the radial dimension of the open seam 58 may be, for example, ⅛ inch with the amount of overlap measured in a circumferential direction being, for example, one inch at the upstream end 53. With reference to FIG. 4, it may be seen that at a position slightly upstream from the folding cone 50, the moving web 20 begins to assume an arcuate shape of relatively large radius as illustrated at 60. At a position 61, a few inches downstream from the folding cone upstream end 53, the gradually decreasing radius of the cone causes the web of sheathing material 20 to assume a smaller radius arcuate shape eventually leading to a non-contacting overlapping relationship of portions of the web as illustrated at position 62. The overlapping relationship is enabled by the open seam 58 of the folding cone 50, which allows one edge portion 25 of the sheathing material to be wrapped inwardly by following the contour of the lower portion 57 of cone overlapping section 55, and which allows the other edge portion 27 of the sheathing material to follow the contour of the upper overlapping section 56, such that no abutting relationship or frictional contact which would tend to defeat the overlapping action of the web material 20 is encountered by web 20 within the folding cone 50. As the sheathing web is overlapped within the cone at an increasingly tighter radius, the filler material 16 is also urged into a more compacted configuration by the pressure exerted through the sheathing material by the surrounding sides of the cone. The density of the filler material at this point may be 3 pounds per cubic foot. At position 63, immediately downstream of the folding cone downstream end 54, the overlapping portions 29, 31, of the sheathing material as illustrated by FIGS. 5 and 6, are brought into contacting relationship with sheathing material edge 27 positioned radially more outwardly than edge 29.

Referring again to FIG. 1, it may be seen that after passing through the folding cone 50, a sheathing web tubularly folded configuration 74 passes through an adhesive applying means such as adhesive spray device 70 which sprayingly injects liquid adhesive 75 onto and through the surfaces of the sheathing material overlapping portions 29, 31. Of course, many different adhesive means might be used such as adhesive applying brushes, rollers, gravity flow devices, or other adhesive applying apparatus well known in the art. The adhesive is generally of an inorganic type such as sodium silicate which is basically non-combustible and which does not lose its adhesive strength, after curing, even when exposed to elevated temperatures. After application of adhesive 72 by the adhesive application means, the folded tubular configuration 74 passes into a sheathing support tube 76, having an inner diameter approximately equal to the desired external diameter of the finished filler rod 80. Tube 76 provides radial support to the tubularly folded sheathing material during the period that the adhesive is forming a bond with the overlapping layers 29, 31 of the sheathing material. The sheathing support tube 76 may be provided with heating elements or cooling elements such as, for example, by fluid coil means 77 positioned about the peripheral of the tube 76 to withdraw or add heat to facilitate the adhesive curing process depending upon the type of adhesive being used. The sheathing support tube may be supported as by vertical brace members 78 etc. mounted on a suitable base means (not shown).

A completed filler rod 80, thus formed, after leaving support tube 76 may be stored on a windup roll 82 of conventional construction. The filler rod 80 may be stored and shipped in such a wound configuration or may alternately be cut in lengths of predetermined dimensions and appropriately packaged for subsequent use in construction applications.

Figure 8:
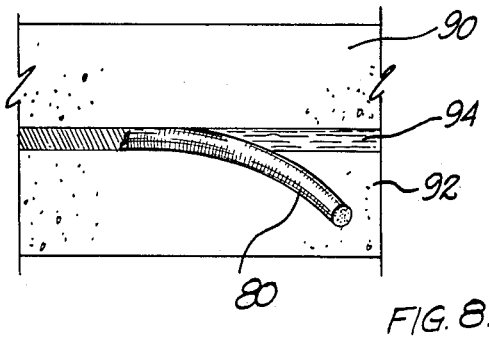
FIG. 8 is a partially broken and pulled away perspective view illustrating placement of a joint filler rod of the present invention in a joint.
Figure 9:
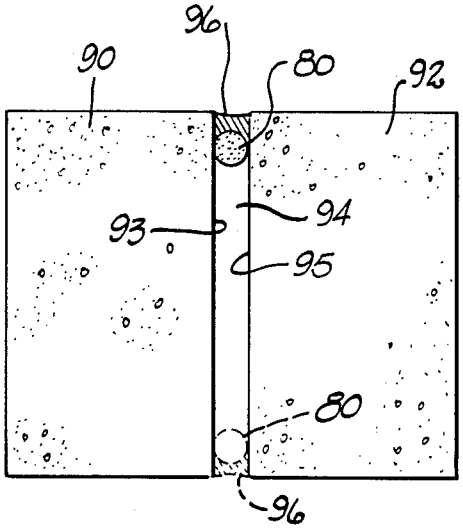
FIG. 9 is a cross-sectional view illustrating a joint filler rod of the present invention placed within a joint.
Figure 10:
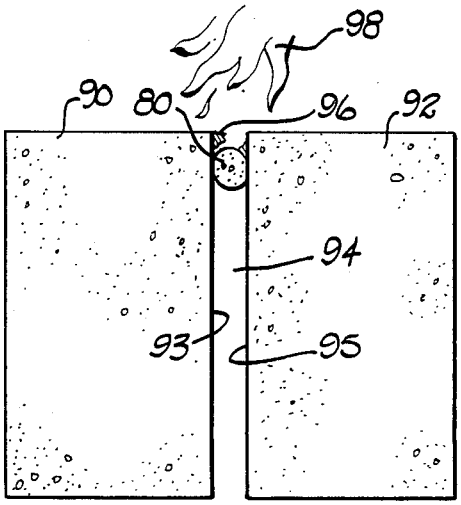
FIG. 10 is a cross-sectional view illustrating a joint filler rod of the embodiment of FIG. 6 expanded within a joint which is exposed to fire on one side.

The manner of applying a backer rod to a joint 94 between building panels 90, 92 is illustrated with reference to FIGS. 8, 9, and 10. The backer rod 80 is inserted into the joint 94 and is initially or subsequently cut to a length approximately equal to or slightly longer than the length of the joint. The filler rod 80 which is used for any particular joint is chosen to have a diameter substantially larger, e.g. 20%–50% larger, than the width of the joint being filled and is thus compressed, e.g., from 4 pounds per cubic foot to a density of 8 pounds per cubic foot, as it is inserted into the joint. The backer rod is pressed into the joint a small distance, e.g. approximately one-half inch, and may be thereafter covered over with a conventional elastomeric sealant material 96, which may be of a type well known in the art. The sealant material 96 initially provides an airtight seal and an aesthetically pleasant appearance at the surface of the joint. As illustrated by FIG. 9, in phantom, the opposite end of the joint 94 may be identically provided with a non-combustible filler rod 80 and sealant material 96 if so desired. The rod may also be used without a sealant material and will allow limited airflow through the joint duct to the porous construction of the filler and sheathing material. As illustrated in FIG. 10, when one surface of a wall formed by the construction panels 90, 92 is exposed to heat and/or flame 98 of sufficient intensity, e.g., a temperature of 400° Fahrenheit, and above the concrete panels 90, 92 expand causing compression of the joint 94 which in turn causes rupturing of sealant 96. Continued exposure to intense heat may cause the sealant material 96 to shrink or fall from the joint 94. However, the filler rod 80 being formed from non-combustible filler material 16, sheathing material 20 and adhesive 75 does not burn, shrink, or separate and, due to the expansion of the panels 90, 92 and the subsequent shrinking of joint 94, rod 80 is urged into even firmer compressive contact with the adjacent walls 93, 99 of the joint 94. This effect may be significantly enhanced by use of a filler material of the composition described with reference to FIG. 6. When filler material of this embodiment is utilized in the filler rod 80, the expansion of minerals 18 causes the filler rod to further expand and thus to be held even more tightly in the joint than in an application with only non-combustible fiber material 17 used for the filling material 16. The relative amount of expansion of the backer rod may, of course, be predetermined by the ratio of mineral material 18 to non-combustible fiber material 17 that is used. When the filler rod 80 is placed in position in a joint, the size of the joint and the density of fiber material in the rod are preferably such that the pressure applied by the building panels further compacts the fiber particles 17 to a density of at least 4 pounds per cubic foot with the fiber material being sufficiently resilient to exert a retaining force against the panels of at least 0.05 pounds per square inch.

It is contemplated that the inventive concepts herein described may be variously otherwise embodied and it is intended that the appended claims may be construed to include alternative embodiments of the invention except insofar as limited by the prior art.

What is claimed is:

1. A non-combustible construction assembly for closing a joint between spaced side surfaces of adjacent building panels made of a non-combustible material such as precast concrete or the like and comprising:

a continuous sheath of non-combustible porous flexible material having a length of approximately as long as the length of the joint and being filled throughout the length thereof with a filler material comprising short length randomly oriented unconnected separate fibers which are compacted by pressure applied by the spaced side surfaces of adjacent building panels to a density of at least 4 pounds per cubic foot and which are sufficiently resilient to exert a retaining force on the side surfaces of at least 0.05 pounds per square inch;

the side surfaces of the adjacent construction panels and the outer surface of said sheath forming a fire tight seal across the joint by mutual expansion of the adjacent building panels when subject to temperatures in excess of 400 degrees Fahrenheit.

2. A length of packing material for providing, filling, and sealing a non-combustible flame barrier suppressant joint between opposite side surfaces of construction panels which comprises a multitude of compacted, randomly oriented, unconnected, separate, individual, small diameter, short length particles of at least one non-combustible material forming a continuous homogeneous length of compressible flexible resilient packing material having a substantially constant cross-sectional configuration; and retaining means associated therewith for maintaining the integrity and cross-sectional consistency of the packing material during manufacture, transportation and placement in the joint and while in position in the joint; whereby the packing material is retained between the opposite side surface of the construction panels by resilient compressive forces and forms a fire tight insulating seal therewith and provides a flame blocking barrier therebetween; wherein said retaining means comprises non-combustible sheath material surrounding and encasing said packing material, said non-combustible sheath material being porous and having a porosity such as to prevent passage of the particles therethrough while permitting substantially unrestricted passage of air therethrough.

3. The invention as defined in claim 2 and wherein said sheath material having opposed edge portions located in overlapping relationship and being adhesively sealed to one another.

4. The invention as defined in claim 2 and wherein said particles comprise fibers of ceramic material.

5. The invention as defined in claim 4 and wherein said particles comprise particles of a temperature sensitive expandable mineral.

6. The invention of claim 5 wherein said particles of expandable material comprise at least one of unexpanded vermiculite and unexpanded perlite.

7. The invention of claim 2, and retaining means comprising:

a continuous length flexible resilient tubular member made of non-combustible woven inorganic material having a porosity of between approximately 20% and 85% per unit area and having a thickness of between approximately 0.004 inches and 0.01 inches;

said tubular member having overlapping side edge portions fixed to one another by non-combustible adhesive material;

said particles of non-combustible material being held in closely spaced compacted relationship only by said continuous length tubular member and having a density of at least 3 pounds per cubic foot in a normal pre-assembly condition and have the capability of being further compacted to a density of at least 8 pounds per cubic foot by compressive forces applied through said tubular member in an assembled condition between the spaced side surfaces of adjacent construction panels;

the cross-sectional size of said tubular member as filled with said fibers being larger than the width of the joint whereby said tubular member is resiliently compressibly insertable and retainable in the joint.

8. The invention of claim 7 wherein said particles of non-combustible material comprise particles of a temperature sensitive expandable material wherein exposure of said material to elevated temperatures of the type experienced in a building fire produce expansion of said expandable material whereby further retaining force is applied to surfaces of said joint engaging said packing material whereby said packing material is further prevented from dislodging from a joint during a building fire.

9. The invention of claim 8 wherein said expandable material comprises at least one of unexpanded vermiculite and unexpanded perlite.

* * * * *